US005382116A

United States Patent [19]

Nakanishi

[11] Patent Number: 5,382,116

[45] Date of Patent: Jan. 17, 1995

[54] GROUND REFORMING METHOD WITH A HARDENING MATERIAL MIXED AND INJECTED AT A SUPER HIGH PRESSURE AND REFORMING DEVICE OF SAME

[75] Inventor: Wataru Nakanishi, Machida, Japan

[73] Assignee: N.I.T. Co., Ltd., Tokyo, Japan

[21] Appl. No.: 66,437

[22] Filed: May 25, 1993

Related U.S. Application Data

[60] Division of Ser. No. 870,232, Apr. 20, 1992, Pat. No. 5,217,327, which is a continuation of Ser. No. 477,125, Feb. 7, 1992, abandoned, which is a continuation of Ser. No. 375,616, Jul. 5, 1989, abandoned.

[30] Foreign Application Priority Data

Nov. 18, 1988 [JP] Japan ..... 63-292078

[51] Int. Cl.[6] ..... E02D 3/12; E02D 5/44

[52] U.S. Cl. ..... 405/269; 405/266

[58] Field of Search ..... 405/266–269

[56] References Cited

U.S. PATENT DOCUMENTS

| | | | |
|---|---|---|---|
| 3,608,318 | 9/1971 | Levy et al. | 405/269 X |
| 4,624,606 | 11/1986 | Nakanishi et al. | 405/269 |
| 4,640,649 | 2/1987 | Nakanishi | 405/237 |
| 4,786,212 | 11/1988 | Bauer et al. | 405/269 |
| 5,123,782 | 6/1992 | Yoshida et al. | 405/269 X |
| 5,141,366 | 8/1992 | Ishida et al. | 405/266 X |

FOREIGN PATENT DOCUMENTS

| | | | |
|---|---|---|---|
| 305235 | 4/1918 | Germany | 405/269 |
| 3737259 | 3/1989 | Germany | 405/269 |
| 142816 | 11/1980 | Japan | 405/269 |
| 24052 | 6/1981 | Japan | 405/269 |
| 51323 | 3/1982 | Japan | 405/269 |

*Primary Examiner*—Randolph A. Reese
*Assistant Examiner*—John A. Ricci
*Attorney, Agent, or Firm*—Joseph W. Berenato, III

[57] ABSTRACT

A ground reforming method comprises a first step for inserting an injection rod into ground to be reformed, which injection rod includes a first conduit and a second conduit surrounding the first conduit, and a first injection nozzle communicated with the first conduit and a second injection nozzle surrounding the first nozzle and communicated with the second conduit; a second step for feeding first component of an instantaneous hardening type hardening material or a slow hardening type hardening material into the first conduit of the injection rod and a second component of the hardening material or compressed gas into the second conduit; and a third step for injecting the first component of the instantaneous hardening type hardening material or the slow hardening type hardening material and the second component or compressed gas at a super high pressure through the first and second nozzles to mix each other with moving back the injection rod from the inserted portion with revolving.

4 Claims, 1 Drawing Sheet

GROUND REFORMING METHOD WITH A HARDENING MATERIAL MIXED AND INJECTED AT A SUPER HIGH PRESSURE AND REFORMING DEVICE OF SAME

This is a division of application Ser. No. 07/870,232 filed Apr. 20, 1992, now U.S. Pat. No. 5,217,327 which is a continuation of application Ser. No. 07/477,125, filed Feb. 7, 1992, now abandoned, which was a continuation in part of application Ser. No. 07/375,616, filed Jul. 5, 1989, now abandoned.

BACKGROUND OF THE INVENTION

1. Field of the Invention

The present invention generally relates to a method for reforming ground-condition by using an instantaneous hardening type or hardening material or a combination of a slow hardening type hardening material or a combination of a slow hardening type hardening material and a high pressure air and a high pressure air to reform soft ground conditions and harden foundations of building sites. More particularly, two components of the instantaneous hardening type hardening material are injected into the ground through a two fluid mixing nozzle at the same occasion.

Further, the present invention relates to a device for reforming ground-condition by using the two fluid mixing nozzle.

2. Description of the Prior Art

Conventionally, various ground reforming methods using a hardening material jet have been provided. In these methods, high pressure and high speed jet injection has been applied to only a slow hardening type hardening material, on the other hand an instantaneous hardening type hardening material has been injected under a low pressure approaching ambient pressure. The high pressure injection has been conducted at highest 200 kg f/cm$^2$, and no injection device adapted for higher injection pressures has yet been proposed.

The instantaneous hardening type hardening material cannot be used for such high pressure injection type ground reforming method because the instantaneous hardening type hardening material is composed of two separated liquids which should be mixed after injection. If these two liquids are mixed prior to injection, the hardening material will be wholly or partially hardened in an injection pump or pipe. Therefore the high pressure injection method has employed the slow hardening type hardening material which requires a long period to achieve hardening. However, the slow hardening type hardening material will sometimes cause problems owing to its slow hardening speed. For example, if the injection amount is increased, the slow hardening type hardening material will flow backwards to leak out of the injection pipe or the like. Special injection angles, such as horizontal injection or upward injection, will remarkably cause such problems and thus cannot employ the high pressure injection method.

In the high pressure injection method, reaction force will be generated at the injection nozzle as the injection pressure is increased, and the reaction force will be applied to an injection rod. Revolving motion of the injection rod will be affected by the reaction force and as a result the injection rod will result in serious trouble.

It is another object of the present invention to provide a ground reforming method available for any type hardening material.

BRIEF SUMMARY OF THE INVENTION

It is therefore an object of the present invention to provide a ground reforming method which can overcome the above described problems.

It is another object of the present invention to provide a ground reforming method available for any type of hardening material.

It is a further object of the present invention to provide a ground reforming method which employs an instantaneous hardening type hardening material injected at a super high pressure of at least 200 kg f/cm$^2$ to reform soft ground and harden foundations of building sites.

It is a further object of the present invention to provide a ground reforming device adapted for the above method.

To accomplish the above objects, the ground reforming method according to the present invention comprises a first step of inserting an injection rod into ground to be reformed, which injection rod includes a first conduit and a second conduit surrounding the first conduit, and a first injection nozzle communicating with the first conduit and a second injection nozzle surrounding the first nozzle and communicating with the second conduit; a second step of individually feeding first and second components of an instantaneous hardening type hardening material or a slow hardening type hardening material and a high pressure air into the first and second conduits of the injection rod; and a third step of injecting the first and second components or the slow hardening type hardening material and the high pressure air under a super high pressure through the first and second nozzles to mix each other with moving back the injection rod from the inserted portion with revolving.

According to another aspect of the present invention, the ground reforming device comprises an injection rod including a first conduit through which a first component of an instantaneous hardening type hardening material or a slow hardening type hardening material is fed and a second conduit through which a second component of the instantaneous hardening type hardening material or a high pressure air is fed, the second conduit surrounding the first conduit; a first injection means communicates with the first conduit, which means includes a pair of first injection nozzles oppositely arranged in a side wall of the injection rod near its top; a second injection means communicates with the second conduit, which second injection means includes a pair of second injection nozzles surroundingly arranged around the first injection nozzles; and a drive means for supporting and driving the injection rod to revolve and move reciprocally.

The first and second components of the instantaneous hardening type hardening material are respectively fed into the first and second conduits without mixing each other under a super high pressure. These components are injected through the injection nozzles and suddenly mix with each other to form a hardening material jet. In the case of the combination of the slow hardening type hardening material and the high pressure air, the slow hardening type hardening material and the high pressure air are also isolatedly fed into the first and second conduits, and injected through the injection nozzles to mix the hardening material jet and the air jet. The hardening material jet is wrapped with the air bubbles and forcibly transported to a wide range by dynamic rupture effect generated when the bubbles are ruptured. The jet injected from the opposite nozzles can absorb reaction force generated by injection from the other side. As the injection rod is revolving and moving back from the inserted position, the ground surrounding the injection rod is reformed into a cylindrical hardened layer.

Other and further objects of this invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF THE PREFERRED EMBODIMENT

A preferred embodiment of the present invention will be explained in conjunction with the accompanying drawings.

Figure 1:
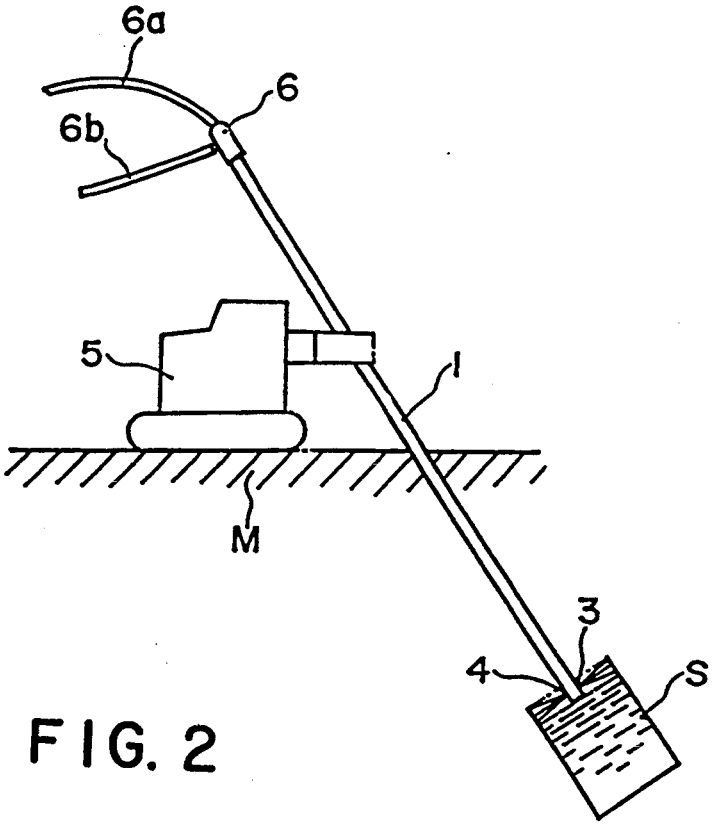
FIG. 1 is a schematic illustration showing one example of working state where the injection rod is inserted in ground.
Figure 2:
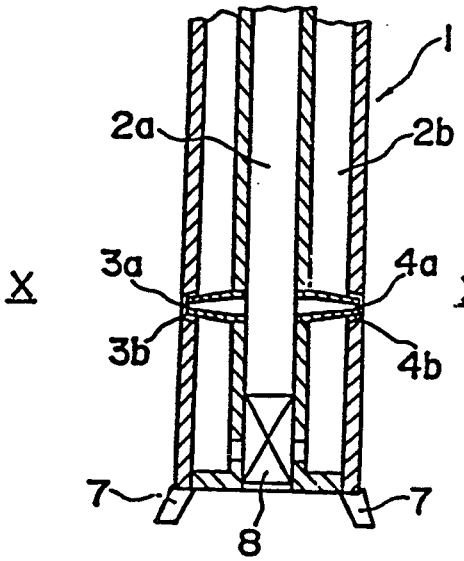
FIG. 2 is a vertical cross sectional view showing the top portion of the injection rod according to the present invention.
Figure 3:
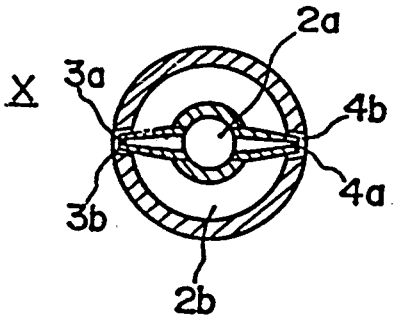
FIG. 3 is a cross sectional view taken along the line X—X in FIG. 2.

In FIG. 1, the reference numeral 1 denotes an injection rod which includes a first conduit 2*a* and a second conduit 2*b* isolated from each other as shown in FIG. 2. The first conduit 2*a* is arranged in a core of the injection rod 1 and is surrounded by the second conduit 2*b*. The first conduit 2*a* communicates with center nozzles 3*a* and 4*a* which are oppositely arranged in the side wall near the tip of the injection rod 1 and extend radially with respect to the longitudinal axis of the injection rod 1. As shown in FIG. 3, the second conduit 2*b* communicates with surrounding nozzles 3*b* and 4*b* whose annular openings surround respectively the center nozzles 3*a* and 4*a*.

The injection rod 1 is supported by a drive unit 5 which revolves and reciprocally moves the injection rod 1. The injection rod 1 is further connected to a first feeding pipe 6*a* and a second feeding pipe 6*b* through a swivel joint 6. Component A of an instantaneous hardening type hardening material is fed into the first conduit 2*a* from the first feeding pipe 6*a*, and component B of the instantaneous hardening type hardening material is fed into the second conduit 2*b* from the second feeding pipe 6*b*. Alternatively, a slow hardening type hardening material per se is fed into the first conduit 2*a* from the first feeding pipe 6*a*, and compressed gas such as air is fed into the second conduit 2*b* from the second feeding pipe 6*b*.

The first and second feeding pipes 6*a* and 6*b* are connected to a compressor, not shown in the drawings, to generate a super high pressure fluid such as the instantaneous hardening type hardening material or gas. The compressor includes a piston, a valve chamber, cylinder and a pressure sensitive member for transmitting pressure from the cylinder to the valve chamber. The pressure sensitive member is composed of active oil having different specific gravity than the instantaneous hardening type hardening material, and an elastic film actuated by the active oil. The active oil is moved in response to the reciprocal motion of the piston so that the hardening material can be introduced into the valve chamber and then discharged out of the chamber by the high pressure. In this compressor the hardening material is isolated from the piston through the pressure sensitive member. Therefore the hardening material can be discharged without energy loss caused by the friction between the piston and the hardening material. The valve chamber is provided with an inlet through which the hardening material is introduced into the chamber and an outlet through which the hardening material is discharged to the feeding pipe. Each of the inlet and the outlet are provided with a valve box whose valve seat is sectionally formed in a half spherical recessed shape. The valve seat is further formed with a plurality of orifices in its axial direction. The valve seat receives a valve member formed in a spherical shape adapting for the valve seat. The valve member is always urged toward the valve seat by a spring. This valve mechanism employing the spherical valve member can promote to increase the discharging pressure.

The drive unit 5 is preferable to be designed so that the drive angle for the injection rod 1 can be freely changed and the drive unit 5 per se can be moved without an additional drive mechanism.

The top of the injection rod 1 is provided with an excavating member 7 and a lubricating unit 8 as shown in FIG. 2. The lubricating unit 8 will discharge lubricant to assist the excavating work of the excavating member 7.

Operation of the ground reforming method according to the present invention will be described. The injection rod 1 while revolving and discharging the lubricant from the lubricating unit 8 is moved towards ground M to be reformed. As the top of the injection rod 1 reaches a predetermined depth, the lubricating unit 8 closes to stop discharging. The component A of the instantaneous hardening type hardening material (or the slow hardening type hardening material) is fed at a super high pressure into the first conduit 2*a* and the component B of the instantaneous hardening type hardening material (or gas) is fed at a super high pressure into the second conduit 2*b*. Both the components A and B are injected outwardly from the injection nozzles 3*a*, 3*b*, 4*a* and 4*b* while the injection rod 1 is moved back while revolving. According to this revolving injection, the components A and B are completely mixed and then an essentially cylindrical hard layer S in the ground M has been generated.

Experiments in sand having N-value 15 to 20 resulted in an excellent reforming effect; that is, the cylindrical hard layer having a large diameter of 3 m 70 cm was obtained under conditions; injection pressure of 400 kg f/cm$^2$, injection rate of 100 l/min, revolving speed of 8 r.p.m., and back-moving speed of 2 cm/min.

As given explanation above, the ground reforming device according to the present invention can inject the instantaneous hardening type hardening material at a super high pressure 200 kg f/cm$^2$ or more. When the instantaneous hardening type hardening material is composed of two components, the two components can be sufficiently and uniformly mixed immediately before application to the ground without back-flowing or leakage. On the other hand, when compressed gas such as air is injected from one injection nozzle and the slow hardening type hardening material is injected from the other nozzle, bubbles are generated by mixing the slow hardening type hardening liquid material and compressed gas. The hardening material jet is wrapped with the bubbles and forcibly transported to a wide range by dynamic rupture effect generated when the bubbles are ruptured. Thus greater area will be hardened into a high density cylindrical hard layer by ruptured hardening material. The cylindrical hard layer may be formed in any configuration such as parallel arrangement or alignment as required.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed. For example, one side of the injection means 3 and 4 or the feeding pipes *6a* and *6b* may be provided with a regulator valve to control injection condition, or the compressor may be further provided with a regulating means.

What is claimed is:

1. A ground reforming method, comprising the steps of:

a) inserting an injection rod into ground to be reformed, the injection rod including a first conduit and a second conduit surrounding the first conduit and having an outer wall, a first radially outwardly directed nozzle secured to and in communication with the second conduit, and a second radially outwardly extending nozzle secured to and in communication with the first nozzle and aligned with and extending into the first nozzle;

b) causing rotary and longitudinal movement of the injection rod;

c) individually feeding first and second components of an instantaneously hardening material into the first and second conduits;

d) discharging at high pressure the first and second components through the first and second nozzles within the periphery of the outer wall; and e) intermixing the first and second components issuing from the first and second nozzles while performing said causing step.

2. A method as in claim 1, including the step of:

a) providing lubrication means disposed within the first conduit for selectively discharging a lubricant coaxially therefrom while concurrently performing said causing step.

3. A method as in claim 1, including the steps of:

a) providing a third radially outwardly extending nozzle secured to and in communication with the second conduit and a fourth radially outwardly extending nozzle secured to and in communication with the first conduit and aligned with and extending into the third nozzle;

b) injecting, at high pressure, the first and second components through the third and fourth nozzles; and c) intermixing material issuing from the third and fourth nozzles at a periphery of the injection rod while concurrently performing said causing step.

4. A method as in claim 3, including the step of:

a) discharging material issuing from the first and second nozzles and from the third and fourth nozzles in opposite radial directions.

* * * * *